United States Patent [19]

McStravick

[11] 4,411,435

[45] Oct. 25, 1983

[54] SEAL ASSEMBLY WITH ENERGIZING MECHANISM

[75] Inventor: David M. McStravick, Houston, Tex.

[73] Assignee: Baker International Corporation, Orange, Calif.

[21] Appl. No.: 273,514

[22] Filed: Jun. 15, 1981

[51] Int. Cl.[3] ..... F16J 15/18

[52] U.S. Cl. ..... 277/9.5; 166/120; 166/136; 277/117; 277/123; 285/355

[58] Field of Search ..... 166/120, 136; 285/324, 285/348, 355, 340; 277/9.5, 26, 31, 123, 117

[56] References Cited

U.S. PATENT DOCUMENTS

| | | | |
|---|---|---|---|
| 1,136,879 | 4/1915 | Hunt | 277/9.5 |
| 1,196,652 | 8/1916 | Brignoni | 277/117 |
| 2,093,129 | 9/1937 | Johnston | 277/9.5 |
| 2,335,025 | 11/1943 | Reed | 277/9.5 |
| 2,862,563 | 12/1958 | Thompson | 277/9.5 |
| 3,036,639 | 5/1962 | Baker | 277/9.5 |
| 3,215,205 | 11/1965 | Sizer | 277/9.5 |
| 3,277,797 | 10/1966 | Tyree et al. | 277/26 |
| 3,645,335 | 2/1972 | Current | 166/120 |
| 3,747,682 | 7/1973 | Taylor | 166/136 |
| 3,968,970 | 7/1976 | Vogeli | 277/123 |
| 4,051,894 | 10/1977 | Goad | 166/73 |

OTHER PUBLICATIONS

Baker Model "D" Drillable Thermoseal Packer Product No. 417-02 and Accessories Model "J" Latching Type Thermoseal Assembly, Product No. 443-52 (unpublished).

*Primary Examiner*—Robert I. Smith

*Attorney, Agent, or Firm*—Norvell & Associates

[57] ABSTRACT

A seal assembly for downhole use in a subterranean well comprises inner and outer concentric annular sealing elements adapted to seal between an inner mandrel and an outer housing. The sealing elements are mounted in concentric annular recesses defined in relatively axially movable seal carrier members. In a preferred form, a spring loaded mechanism is provided to bias the seal carriers axially towards each other, thereby exerting an axially compressive force on the sealing elements between them. The compressive force is sufficient to expand the sealing elements against the sealing surfaces of the mandrel and outer housing, whereby non-elastomeric sealing elements, or seal elements which have become effectively non-elastomeric, can be utilized. Releasable latches are provided for attachment of the seal assembly to the associated housing.

16 Claims, 5 Drawing Figures

SEAL ASSEMBLY WITH ENERGIZING MECHANISM

BACKGROUND OF THE INVENTION

1. Field of the Invention

The invention relates to a seal assembly, for example, in an expansion joint, for use in a subterranean well in an environment hostile to common elastomers.

2. Description of the Prior Art

A common sealing member in subterranean well tools is a nitrile rubber O-ring or chevron seal. A typical application of such a sealing member is in a tubing string expansion joint. Owing to temperature changes and pressure changes along the tubing string, the length of the tubing string varies. When the lower end of the string is anchored in the well casing, as by a packer, or a casing bore receptacle, an expansion joint is provided to compensate for the changes in tubing string length to avoid excessive forces and buckling of the tubing. An expansion joint commonly comprises two telescoping sleeve members sealed by annular, elastomeric sealing elements between the telescoping members. The sealing elements are normally maintained in compression, whereby the elastomeric property of the sealing elements maintains sealing pressure against the sealing surfaces of the telescoping members, even with temperature changes and pressure cycling.

The environment in many deep gas wells is characterized by the presence of high temperatures, carbon dioxide, and hydrogen sulfide. Common elastomers such as nitrile rubber will rapidly deteriorate in such an environment. Furthermore, elastomeric materials often take a "compression set", particularly in these environments. In dynamic seal applications, this set results in a loss of elasticity with time, which will result in leaks with pressure and temperature cycling. Such elastomeric materials are thus made effectively non-elastomeric at the time of, or during, sealing, because of such compressive set. Non-elastomeric materials such polytetrafluoroethylene, known by the trademark Teflon, are known as sealing materials having resistance to such environments. Such materials, however, have not been used alone in dynamic seals in subterranean wells because there are not self-energizing, that is, sealing pressure cannot be maintained merely by elastomeric compression and expansion. Furthermore, after the loss of sealing material, by extrusion for example, elastomers expand to maintain pressured sealing contact, while non-elastomers normally do not.

SUMMARY OF THE INVENTION

The invention provides a seal assembly having non-elastomeric sealing elements or elastomeric sealing elements which have become effectively non-elastomeric, and means for energizing same to maintain pressured sealing contact with sealing surfaces.

The annular seal assembly includes upper and lower annular seal carriers, a spring housing above the seal carriers, and latch means for maintaining spring compression.

The upper annular seal carrier includes an integral, lower annular portion having an increased inside diameter and a decreased outside diameter defining a relatively narrow sectioned lower portion and inner and outer annular recesses in the inside and outside annular surfaces. Inner and outer annular sealing members, formed of polytetrafluoroethylene, for example, are respectively mounted in the inside and outside recesses.

The upwardly facing lower end surfaces of the recesses are defined by upper surfaces of the lower annular seal carrier. The lower seal carrier is axially shiftable relative to the upper seal carrier, whereby the sealing members can be axially compressed within the annular recesses defined between the upper and lower seal carriers.

An annular spring housing is attached to the upper seal carrier above the sealing members, by engagement of radial pins in axial slots, thereby providing for transmission of torque and limited relative axial movement between the spring housing and the seal carriers. A plurality of Belleville springs are axially stacked in an annular chamber within the spring housing. The springs are arranged to be compressible between the spring housing and the upper seal carrier. Latch means are provided for latching the spring housing in an axial position fixed relative to the lower seal carrier, whereby the restorative force of the compressed springs continuously exerts an axially compressive force on the annular sealing members.

When the seal assembly is incorporated in an expansion joint, the seal assembly is arranged to fit sealingly between an outer annular housing and an inner expansion joint mandrel. The annular seal assembly is first disposed on the outside cylindrical surface of the expansion joint mandrel, and secured to the mandrel by a shear pin. The mandrel and seal assembly are then run into the expansion joint housing, until the seal assembly contacts a shoulder projecting inwardly from the inside cylindrical surface of the expansion joint housing. Continued downward movement of the mandrel shears the shear pin and brings a downwardly facing, outwardly projecting shoulder on the mandrel into contact with the top of the spring housing. Further downward movement of the mandrel then compresses the seal assembly between the downwardly facing shoulder on the mandrel and the upwardly facing shoulder on the expansion joint housing, thereby compressing the Belleville springs. The latch means on the spring housing engage corresponding latch means on the expansion joint housing, thereby maintaining the seal assembly in a compressed configuration.

In this configuration, the seal assembly is secured to the expansion joint housing. The outer annular sealing member is in sealing contact with the inside cylindrical surface of the housing, and the inner sealing member is in sliding, sealing contact with the outside cylindrical surface of the mandrel of the expansion joint. The compressed Belleville springs urge the upper seal carrier towards the lower seal carrier, thereby tending to axially compress the sealing members in the recess defined by the seal carriers. This compression mechanically energizes the sealing members, to compensate for their lack of elasticity.

Radial ports are formed through the upper seal carrier between the inner and outer recesses for the sealing members. If there is any loss of material from either of the sealing members, some sealing material will be extruded through the port, by the axial compressive force on the sealing members, thereby equalizing the compressive force on each sealing member.

DESCRIPTION OF THE PREFERRED EMBODIMENTS

Figure 1A:
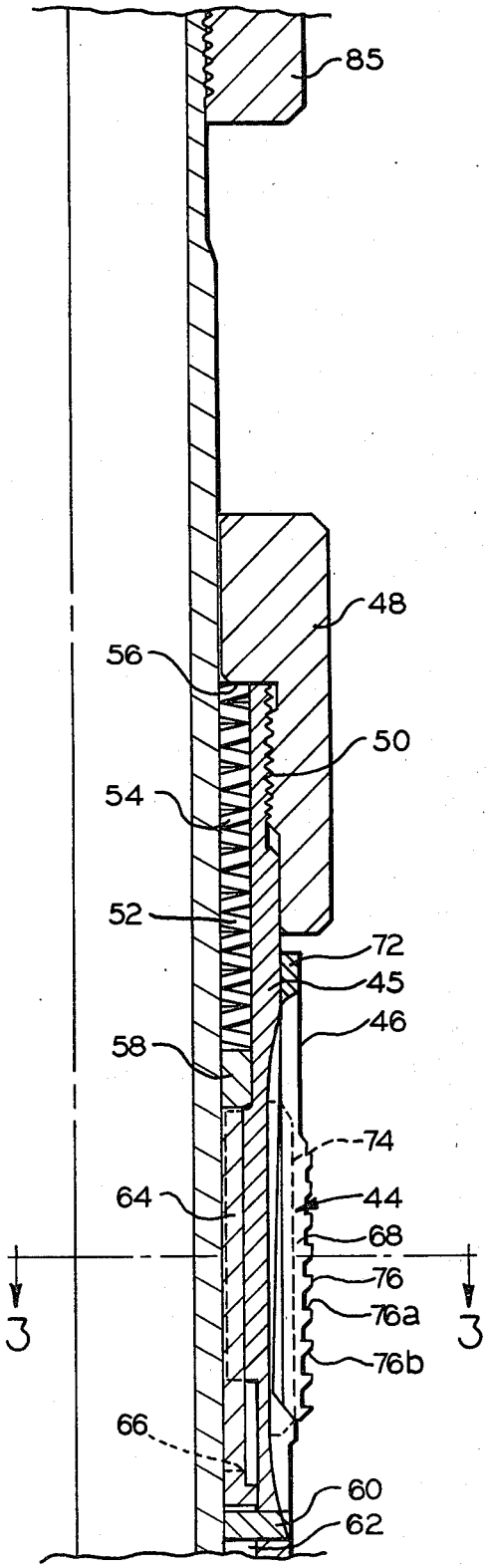
FIGS. 1A and 1B are an elevational view in half section, illustrating a seal assembly embodying the present invention being run into a packer bore on an associated expansion joint mandrel, FIG. 1A being uppermost and FIG. 1B a lower continuation thereof.

As illustrated in the drawings, an annular seal assembly 1 embodying the invention utilizes inner and outer concentric sealing members 10 and 12 formed of a non-elastomeric material, such as polytetrafluoroethylene, which can withstand the environmental conditions encountered in a subterranean well. As part of a sealed expansion joint, the seal assembly forms a sliding seal between the outside polished sealing surface 14 of an expansion joint mandrel 16 and the sealing bore 18 of a packer 20.

The seal assembly 1 comprises an annular upper seal carrier 22, and an annular lower seal carrier 24. The upper seal carrier 22 includes a lower annular portion 26 having an increased inside diameter and a decreased outside diameter, thereby defining inner and outer annular recesses 28 and 30. The inner and outer sealing members 10 and 12 are respectively mounted in the inner and outer recesses 28 and 30. Circumferentially spaced radial ports 32 are provided in the lower portion 26 of the upper seal carrier 22 and are filled with the same material of which the sealing members 10 and 12 are formed.

An upwardly opening annular recess 34 formed in the lower seal carrier 24 receives the annular lower portion 26 of the upper seal carrier 22. Upwardly facing annular surfaces 36 and 38 of the lower seal carrier 24, on either side of the lower portion 26 define the lower limits of the inner and outer seal recesses 28 and 30, respectively. Upper limits of the recesses 28 and 30 are defined by the downwardly facing shoulders 39 and 41 of the upper seal carrier 22. The upper seal carrier 22 and lower seal carrier 24 are relatively axially movable, as the lower portion 26 of the upper seal carrier 22 moves telescopingly within the recess 34 of the lower seal carrier 24. Hence the sealing members 10 and 12 can be axially compressed between the upper and lower seal carriers 22 and 24 by means to be described, to provide an energizing force for the non-elastomeric sealing members 10 and 12.

The lower portion 26 of the upper seal carrier 22 includes a plurality of circumferentially spaced, axially extending keyways 40 formed radially therethrough. Key pins 42 are secured to the lower seal carrier 24, and extend across the recess 34, through respective keyways 40. The engagement of the key pins 42 and the keyways 40 permits transmission of torque between the lower seal carrier 24 and the upper seal carrier 22, while permitting relative axial movement between the seal carriers 22 and 24.

Means for biasing the upper and lower seal carriers 22 and 24 towards each other to axially compress and energize the sealing members 10 and 12 is provided by the spring housing 44 disposed above the upper seal carrier 22. The spring housing 44 comprise a latch collet support sleeve 45 and a top retaining nut 48 attached to the latch collet support sleeve 45 by a threaded connection 50. The retaining nut 48 and the latch collet support sleeve 45 define between them an annular chamber 52, in which a plurality of annular Belleville springs 54 are stacked. The upper limit of the chamber 52 is defined by a downwardly facing annular shoulder 56 of the retaining nut 48, and the lower limit of the chamber 52 is defined by an annular spring base 58.

The latch collet support sleeve 45 is secured to the upper seal carrier 22 by means of a key pin 60 projecting inwardly from the latch collet support sleeve 45 into an axially extending keyway 62 formed in the upper seal carrier 22. The engagement of the key pin 60 in the keyway 62 permits a limited axial movement between the upper seal carrier 22 and the latch collet support sleeve 45. As illustrated in cross section in FIG. 3, the upper seal carrier 22 above the key pin 60 comprises four axially extending splines 64. The inside cylindrical surface of the latch collet support sleeve 45 includes complementary axially extending slots 66. Engagement of the spline 64 in the slots 66 also provides for torque transmission between the upper seal carrier 22 and the latch collet support sleeve 45. The annular spring base 58 is supported on the upper surfaces of the splines 64.

Figure 3:
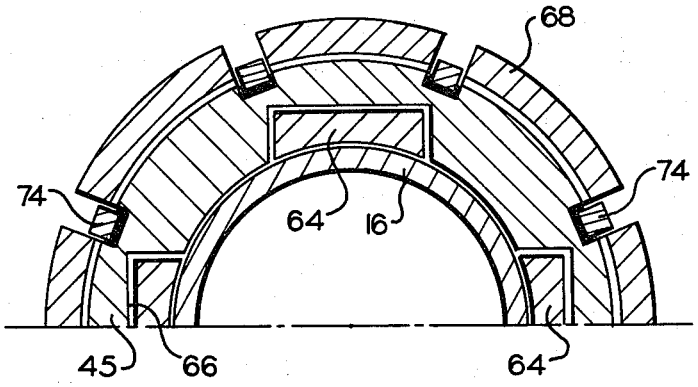
FIG. 3 is a sectional view taken on the line 3—3 of FIG. 1A.

The latch collet 46 comprises a plurality of integral, resilient, latch arms 68 adapted to engage complementary latch threads 70 on the packer 20. As illustrated in FIG. 3, the latch arms 68 are circumferentially spaced, and are integrally connected only through an upper annular portion 72 of the latch collet 46 which is mounted on the support sleeve 45. Axial keys 74 are disposed within the axial slots between the latch arms 68 to facilitate transmission of torque between the inner portion of the latch collet 46 and the latch arms 68 (FIG. 3).

The outside surfaces of the latch arms 68 are grooved to define a discontinuous, left-hand, helical thread 76. The depth of the thread 76 increases downwardly. Upwardly facing walls **76*a* of the thread 76 extend radially, and the downwardly facing walls 76*b* taper downwardly and inwardly. The cooperating latch threads 70 on the packer 20** are square-threaded and are cut with a complementary taper of thread depth.

The entire seal assembly 1 is attached by means of shear pins 78 to a lower annular nut 80 forming the extreme lower end of the mandrel 16. The extreme upper end of the lower nut 80 is castellated, that is, it includes circumferentially spaced upward projections 82 arranged to fit within corresponding recesses 84 formed in the lower seal carrier 24. The upper end of the mandrel 16 is connected by means of a threaded sub 85 to the lower end of a tubing string (not shown).

Figure 1B:
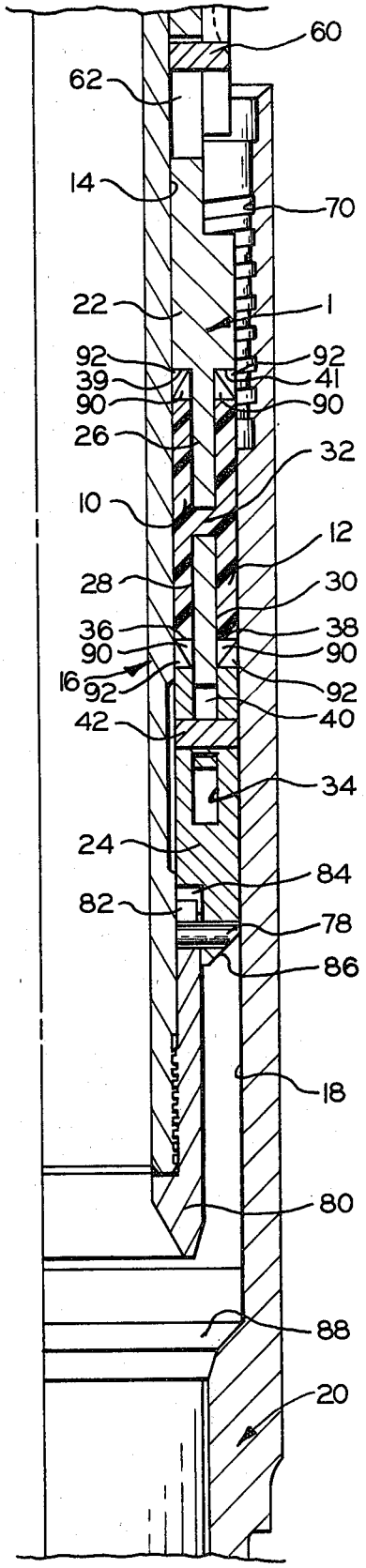

In FIG. 1, the seal assembly 1 is illustrated as being carried by the mandrel 16 and run into position within the packer seal bore 18 to make up an expansion joint. Continued downward movement of the mandrel 16 and seal assembly 1 will bring a downwardly and inwardly tapering shoulder 86 defining the lower end of the lower seal carrier 24 into contact with a downwardly and inwardly tapering, upwardly facing no-go shoulder 88 which projects inwardly from the seal bore 18 of the packer 20 (FIG. 2B). Downward jarring on the mandrel will then shear the shear pin 78, thereby freeing the mandrel 16 for further downward movement, bringing the connecting sub 85 into contact with the retaining nut 48 of the spring housing 44, as illustrated in FIGS. 2A and 2B.

Figure 2A:
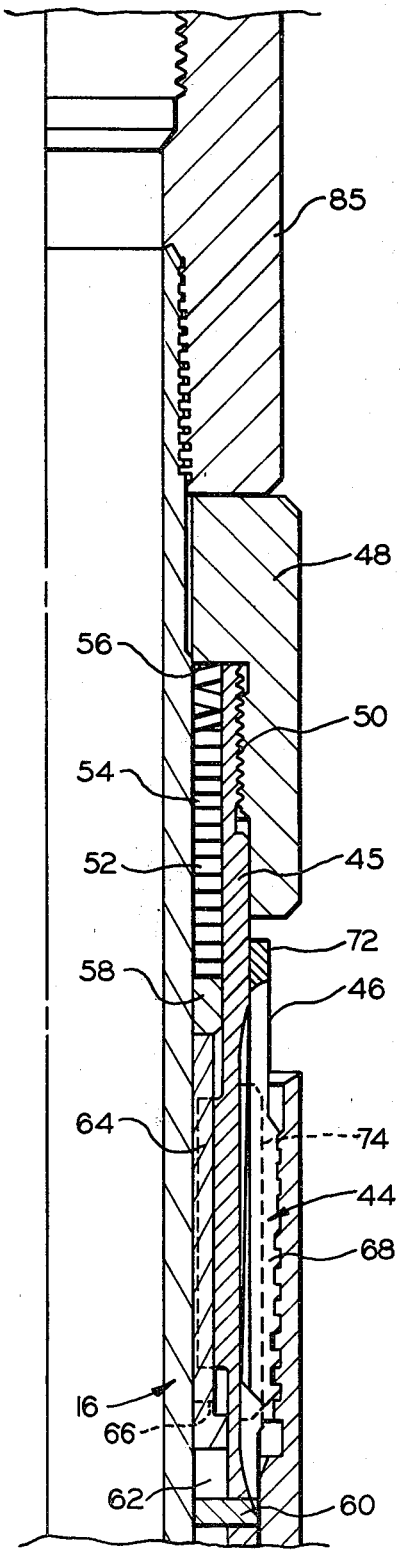
FIGS. 2A and 2B are an elevational view in half section, illustrating the seal assembly in an operating mode, secured to the packer, and forming a seal between the packer bore and the sliding expansion joint mandrel.
Figure 2B:
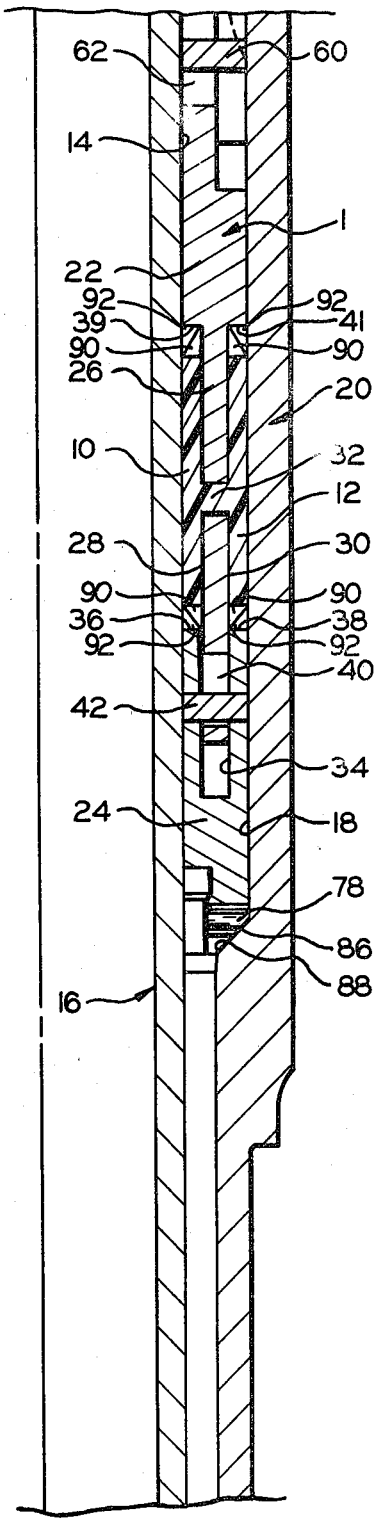

Continued downward movement of the mandrel 16 will compress the Belleville springs 54 and force the latch arms 68 of collet 46 into engagement with the latch threads 70 on the packer 20, as illustrated in FIG. 2A. As the latch arms 68 are moved downwardly into engagement with the latch threads 70, the lower tapered surfaces **76*b* of the discontinuous thread 76 are cammed inwardly by the square threads 70, thereby causing the latch arms 68 to resiliently flex radially inwardly. The engagement of the upper horizontal surfaces 76*a* of the discontinuous threads 76 with the square latch thread 70 prevents upward retraction of the latch arms 68 from the packer 20. Hence the latch arms 68 and the latch thread 70 operate as a pawl and ratchet, permitting insertion of the latch collet 46 as the latch arms 68 resiliently flex, but preventing retraction of the latch collet 46. After being run into the packer 20 as described above, the seal assembly 1 is fixed relative to the packer 20, by engagement of the latch arms 68 with the latch thread 70, and by the engagement of the shoulder 86 of the seal carrier 24 with the no-go shoulder 88 of the packer 20. The mandrel 16 is free to slide axially within the seal assembly 1**.

In the operating mode of the seal assembly 1 illustrated in FIGS. 2A and 2B, the compressed Belleville springs 54 exert a downwardly directed axial force on the sealing members 10 and 12, through the spring base 58 and the upper seal carrier 22. Hence the restorative force of the compressive Belleville springs 54 tends to compress the sealing members 10 and 12 between the upper and lower seal carriers 22 and 24. The compressive force will distort the seal members 10 and 12 sufficiently to maintain sealing contact against the seal bore 18 of the packer and the outside sealing surface 14 of the expansion joint mandrel 16, even though the sealing members are not elastomeric. Preferred materials for the sealing members 10 and 12 are polytetrafluoroethylene, known by the trademark Teflon, and polyphenolene sulfide, known by the trademark Ryton. Additionally, graphite-containing elements also may be utilized. These materials, though not elastomeric, can be energized as described to maintain sealing contact, and are highly resistant to the hostile environments typically encountered in deep gas wells. The sealing members may also be provided together with an anti-extrusion ring adjacent thereto, such as an element or ring having wire mesh therein, either alone or with an asbestos-laden material weaved or emplaced therein, or other filler material.

In the event of loss of sealing material from only one sealing member, as by abrasion, that member would bear less of the axially compressive energizing force, and would therefore be more likely to leak. In such an event, the ports 32 formed through the lower portion 26 of the upper seal carrier 22, between the inner and outer recesses 28 and 30, provide for the equalization of the energizing force. Some sealing material can extrude through the ports 32 from the energized sealing member, thereby equalizing the compressive energizing force on the two sealing members 10 and 12.

Preferably, a pair of anti-extrusion rings 90 and 92 are provided at each axial end of each sealing member 10 and 12. The anti-extrusion rings 90, adjacent the sealing members 10 and 12, include conical camming surfaces facing away from the sealing members 10 and 12. The anti-extrusion rings 92 have complementary conical camming surfaces abutting the anti-extrusion rings 90. Hence, compression of the upper and lower seal carriers 22 and 24 tends to wedge the anti-extrusion rings tightly against the lower portion 26 of the upper seal carrier and the seal bore 18 or the sealing surface 14 of the mandrel 16, thereby preventing extrusion of sealing material through the expansion joint.

The seal assembly 1 is retrievable by surface-controlled movement of the mandrel 16. To remove the seal assembly, the mandrel is picked up until the castellated lower nut 80 of the mandrel 16 engages the cooperating recesses 84 formed in the lower seal carrier 24, as shown in FIG. 1B. Right hand rotation of the mandrel 16 will then rotate the seal assembly 1, unthreading the threads 76 of the latch arms 68 from the latch threads 70 on the packer 20. During rotation, torque is transmitted through the lower seal carrier 22, the key pins 42 and keyways 40, and the slots 66 and axial splines 64 of the upper seal carrier 22. Twisting of the latch arms 68 is prevented by the keys 74 disposed within the slots between the latch arms 68.

Although the invention has been described in terms of specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. An expansion joint positionable with a subterranean well between upper and lower conduit member secured thereto, comprising: a plurality of telescoping members, including an outer annular housing, and an inner annular mandrel; a nonelastomeric annular sealing member in sealing contact with the outside annular surface of said mandrel and the inside annular surface of said housing; energizing means exerting an axially compressive force on said sealing member; first means for releasably attaching the seal assembly to the mandrel; second means for attaching the seal assembly to the housing and for actuating the energizing means, the mandrel being movable axially relative to the seal assembly with the energizing means biasing the seal assembly relative to the housing, whereby a dynamic seal is maintained relative to the mandrel and a static seal being maintained relative to the housing.

2. The expansion joint defined in claim 1 wherein said energizing means comprises compression spring means operatively disposed between one of said telescoping members and one axial end of said annular sealing member.

3. A seal assembly for forming dynamic fluid seals between an outside annular sealing surface and a concentric inside annular sealing surface comprising an annular seal carrier adapted to fit concentrically between said annular sealing surfaces and including inner and outer concentric annular recesses formed therein; inner and outer annular sealing members respectively mounted in said inner and outer annular recesses of said seal carrier, adapted to sealingly engage said sealing surfaces; said carrier including upper and lower axially movable carrier portions; said upper carrier including inner and outer downwardly facing shoulders defining the upper limits of said inner and outer recesses, said lower carrier including upwardly facing annular shoulders defining the lower limits of said inner and outer recesses; and means for biasing said upper and lower carrier portions axially together, thereby exerting an axial compressing force on said annular sealing members.

4. The seal assembly defined in claim 3 including spring means for biasing said upper and lower carrier portions axially towards each other, thereby compressing and energizing said annular sealing members.

5. The seal assembly defined in claim 4 wherein said spring means includes an axial stack of annular Belleville springs.

6. The seal assembly defined in claim 3 wherein said sealing members comprise polytetrafluoroethylene.

7. The seal assembly defined in claim 3 wherein said sealing members comprise polyphenolene sulfide.

8. The seal assembly defined in claim 3 including an annular spring housing axially shiftable relative to said seal carrier, spring means between said spring housing and one of said upper and lower carrier portions, said spring housing being axially shiftable to a position in which said spring means is compressed between said housing and said one of said carrier portions, and means for latching said spring housing and the other of said carrier portions in a fixed relative axial position, whereby the restorative force of the compressed spring means exerts a compressive force on said sealing members.

9. The seal assembly defined in claim 8 wherein said means for latching said spring housing and said carrier portion comprise resilient latch arms on said spring housing and cooperating latch means on said outside annular associated sealing surface.

10. The seal assembly defined in claim 9 wherein said resilient latch arms on said spring housing include a discontinuous helical thread and said cooperating latch means on said outside annular sealing surface comprises a cooperating helical thread.

11. The seal assembly defined in claim 8 including spline means on said spring housing and said seal carrier for torque transmission.

12. The seal assembly defined in claim 11 comprising an expansion joint mandrel including said inside annular sealing surface, releasable means for securing said seal carrier to said mandrel, and selectively engageable means for transmitting torque between said mandrel and said seal carrier.

13. The seal assembly defined in claim 3 wherein said seal carrier includes radial ports formed therein between said inner and outer concentric annular recesses for said sealing members.

14. The seal assembly defined in claim 3 including anti-extrusion rings disposed in said annular recesses for said sealing members, said anti-extrusion rings being respectively located between said shoulders defining upper and lower limits of said recesses and the upper and lower ends of said sealing members.

15. A seal assembly for a tool adapted for downhole residence in a subterranean well wherein the seal element is subjected to a loss of elasticity over time, comprising: a sealing member initially being elastomeric when a sealing surface thereof is in contact with an associated sealing surface of the tool; and means for energizing said sealing member by applying a continuous compressive force on said sealing member sufficient to expand same into continuous sealing contact with said sealing surface of the tool, whereby sealing contact with the associated surface is maintained despite the loss of elasticity of the sealing element.

16. A seal assembly for establishing static and dynamic pressured sealing integrity between concentric relatively telescoping members in a subterranean well, comprising: a nonelastomeric sealing member having a sealing surface in contact with associated sealing surfaces on each of the concentric telescoping members; spring means for applying a continuous axial force on said sealing member to energize said sealing member; first means for releasably attaching the sealing assembly to a first relatively telescoping member; second means for attaching the seal assembly to a second relatively telescoping member and for energizing the spring means, whereby the first relatively telescoping member moves axially relative to the seal assembly with the spring means biasing the seal assembly relative to the second relatively telescoping member so that a dynamic seal is maintained relative to the first relatively telescoping member and a static seal being maintained relative to the second relatively telescoping member.

* * * * *